United States Patent [19]

Harte et al.

[11] 4,342,949

[45] Aug. 3, 1982

[54] CHARGED PARTICLE BEAM STRUCTURE HAVING ELECTROSTATIC COARSE AND FINE DOUBLE DEFLECTION SYSTEM WITH DYNAMIC FOCUS AND DIVERGING BEAM

[75] Inventors: Kenneth J. Harte, Carlisle; Edward C. Dougherty, Dracut, both of Mass.

[73] Assignee: Control Data Corporation, Minneapolis, Minn.

[21] Appl. No.: 93,008

[22] Filed: Nov. 9, 1979

[51] Int. Cl.[3] ..... H01J 29/70; H01J 29/74

[52] U.S. Cl. ..... 315/409

[58] Field of Search ..... 315/14, 15, 382, 31 R, 315/370, 409

[56] References Cited

U.S. PATENT DOCUMENTS 3,319,110 5/1967 Schlesinger ..... 315/382
3,417,199 12/1968 Yoshida et al. .
4,142,132 2/1979 Harte ..... 315/370

*Primary Examiner*—Theodore M. Blum
*Attorney, Agent, or Firm*—Charles W. Helzer

[57] ABSTRACT

An electron beam or other charged particle beam tube of the compound fly's eye type having a coarse deflection system is described. The beam tube comprises an evacuated housing together with an electron gun or other charged particle beam producing means disposed at one end of the evacuated housing for producing a beam of electrons or other charged particles. A coarse deflector, a compound micro lens assembly, and a fine deflector are disposed in the housing in the path of the electron or other charged particle beam for first selecting a lenslet and thereafter finely deflecting an electron or other charged particle beam to a desired spot on a target plane. The electron or other charged particle beam tube is designed in a manner such that the electron or other charged particle beam is caused to diverge at a small angle of divergence in advance of passing through the coarse deflector by appropriately locating the virtual origin or point source of the charged particle a small distance in advance of the coarse deflector.

In addition, a dynamic focusing correction potential is supplied to the micro lens assembly along with a high voltage energizing potential with the dynamic focusing correction potential being derived from components of both the coarse deflection potentials and the fine deflection potentials.

35 Claims, 7 Drawing Figures

CHARGED PARTICLE BEAM STRUCTURE HAVING ELECTROSTATIC COARSE AND FINE DOUBLE DEFLECTION SYSTEM WITH DYNAMIC FOCUS AND DIVERGING BEAM

BACKGROUND OF INVENTION

1. Field of Invention

This invention relates to improved methods and apparatus for dynamic correction and minimization of aberrations produced in the beam of electrons or other charged particle in tubes or columns of the electron beam type. The invention is particularly well suited for use with electron beam tubes of the fly's eye compound lens type employing a two stage eight-fold coarse electrostatic deflector system and an array fine deflector system.

2. Prior Art Problem

U.S. Pat. No. 4,142,132, issued Feb. 27, 1979, entitled "Method and Means for Dynamic Correction of Electrostatic Deflector for Electron Beam Tube"—Kenneth J. Harte, inventor, describes and claims a greatly improved eight-fold electrostatic deflection system for electron beam and other charged particle beam tubes employing electrostatic deflection systems. The tube described in U.S. Pat. No. 4,142,132 is designed for use in an electron beam addressable memory wherein the number of data storage sites that the electron optical system can resolve at the target plane of the tube (at fixed current density), or the current density that can be achieved with such a tube (with a fixed number of data bit sites), varies inversely with the electron beam spot aberration at the target plane. As stated in the above referenced U.S. Pat. No. 4,142,132, electron beam spot aberration is introduced by an electrostatic deflector system as it causes the electron or other charged particle beam to traverse from a center-axis position across the x-y plane of a target surface to a particular x-y address bit site location whose x-y coordinates identify the data to be stored and/or retrieved. For maximum data storage capability on a given target surface area, electron beam spot aberration must be kept to a minimum.

The eight-fold electrostatic deflection system and methods of correction described in the above referenced U.S. Pat. No. 4,142,132 provide greatly improved performance and minimize to a considerable extent beam spot aberration at the target plane. The present invention is designed to complement the desirable features of the eight-fold deflection system and method of correction described in U.S. Pat. No. 4,142,132 and to thereby provide improved performance and minimization of beam spot aberration at the target plane.

SUMMARY OF INVENTION

It is therefore a primary object of the invention to provide a new and improved method and system for correction and minimization of electron beam spot aberrations in electron beam and other charged particle tubes.

In practicing the invention, an electron beam or other charged particle beam tube is provided which preferably employs an electrostatic deflection system. The tube comprises an evacuated housing and an electron gun or other charged particle emitter disposed at one end of the evacuated housing for producing a beam of electrons or other charged particles. A deflector is secured on the housing between the charged particle emitter and a target plane and is disposed about the path of the charged particle beam and is followed by lens. The deflector preferably comprises one or two sets of eight electrically conductive, spaced-apart deflector elements which are electrically isolated one from the other and annularly arranged around the center electron beam (charged particle) path. Means are provided for applying electrical signals to the deflector for deflecting the electron or other charged particle beam to a desired point on a target plane. The lens preferably is of the array or fly's eye type. The improvement comprises the addition of electron beam or other charged particle beam divergence means for causing the electron or other charged particle beam to diverge at a small angle of divergence in advance of passing through the deflector system and then through the lens. The arrangement is such that the beam has a source point, or crossover near the entrance of the deflector, rather than an infinite distance away as is the case for a collimated beam. The desired source point can be controlled by appropriately designing the electron gun or other charged particle emitter through manipulation of the various parameters of the gun, for example, the spacing of the aperture formed in the anode of the electron gun from the cathode and control grid thereof, the size and shape of the aperture, the use of one or two additional elements to form tetrode or pentode stuctures, respectively, the adjustment of the value of the energizing potentials applied to the gun and the spacing from the gun to the deflector. Alternatively, a condenser lens can be imposed in the electron beam tube intermediate the electron gun and the deflector or a two stage serially arranged condenser lens assembly can be employed and the value of the energizing potentials applied to the focusing elements of the condenser lens adjusted to provide the desired source point for the electron or other charged particle beam.

Preferably, correction electric potentials also are applied to the respective members of the preferred eight-fold deflector means in conjunction with the deflection electric potentials in order to further minimize electron beam spot aberration at the target plane as taught in the above cited U.S. Pat. No. 4,142,132 wherein the correction electric potentials are comprised by two different quadrupole correction electric potentials applied to selected ones of the eight-fold deflector members and an octupole correction electric potential applied to all eight deflector members.

The deflector system preferably comprises the coarse deflector of a compound fly's eye type electron beam tube having both an eight-fold coarse electrostatic deflector system and a fine micro deflector system disposed between the target plane and the eight-fold coarse deflector system, together with an objective lens array of the fly's eye type interposed between the eight-fold coarse deflector system and the micro deflector system. In a preferred embodiment, the invention further includes means for applying a dynamic focusing potential to the objective lens array wherein the dynamic focusing electric potential is derived from both the eight-fold coarse deflection potentials and the fine deflection potentials.

BRIEF DESCRIPTION OF DRAWINGS

The above and other objects, features and many of the attendant advantages of this invention will be appreciated more readily as the same becomes better understood from a reading of the following detailed description, when considered in connection with the accompanying drawings, wherein like parts in each of the several figures are identified by the same reference character, and wherein.

DETAILED DESCRIPTION OF PREFERRED EMBODIMENT

Figure 1:
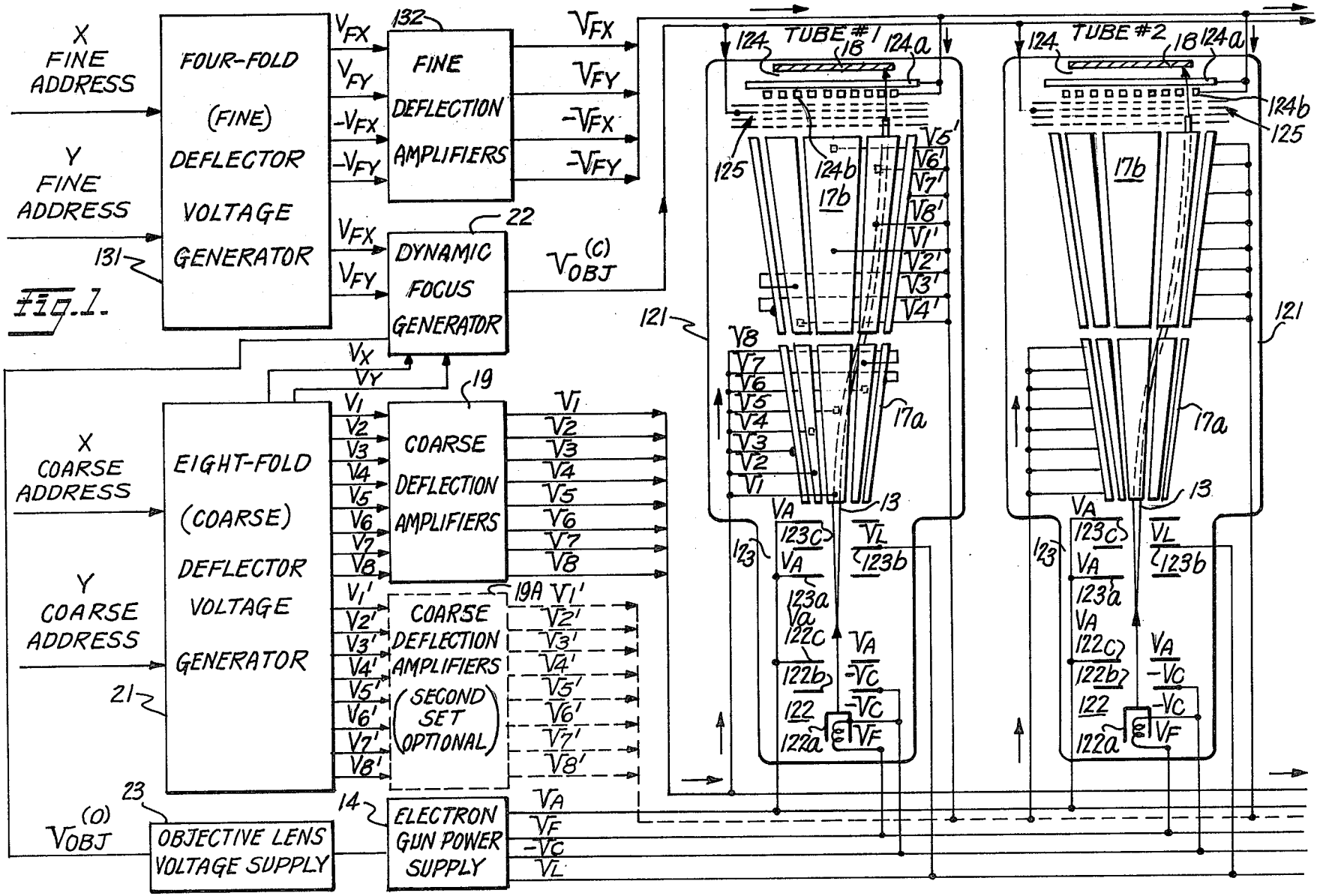
FIG. 1 is a functional block diagram of a compound fly's eye type of electron beam accessable memory (EBAM) illustrating the improved method and circuit means for dynamic correction and minimization of electron beam spot aberration at the target plane of the several EBAM tubes employed in the system illustrated.
Figure 3:
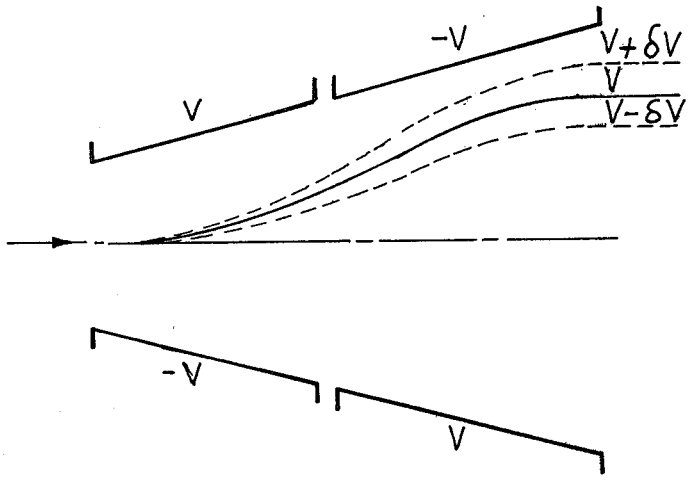
FIG. 3 is a schematic illustration of three initially axial beam paths corresponding to three slightly different voltages and occuring in the prior art eight-fold electrostatic deflector system according to U.S. Pat. No. 4,142,132 which the deflector is designed to produce with a well-collimated, highly focused electron beam.

FIG. 1 of the drawings is a schematic block diagram of a compound, fly's eye, array optics EBAM system constructed according to the present invention and corresponds in most respects to the EBAM system described and claimed in FIG. 3 of the above referenced U.S. Pat. No. 4,142,132. Because of the similarities in the two systems, the disclosure of U.S. Pat. No. 4,142,132 hereby is incorporated in its entirety into the present application and the reference numerals used in the prior art description have been employed to identify corresponding parts in the present invention.

The heart of the EBAM system shown in FIG. 1 is comprised by a plurality of compound fly's eye type electron beam tubes 121 of which there may be a large number, but only two of which are shown in FIG. 1 for simplicity of illustration. The compound fly's eye type electron beam tubes 121 are identical in construction and operation so that only one of the tubes need be described in detail. Each tube 121 is comprised by an outer, evacuated housing member of glass, steel or other impervious material in which is mounted at one end an electron gun 122 having a dispenser type cathode **122*a*, a control grid 122*b* and an anode 122*c* of conventional construction for producing a beam of electrons indicated generally in dotted outline form at 13. Although tube 121 is illustrated as employing a dispenser type cathode in the electron gun thereof in order to simplify both the electron optics and array optics systems, it is believed obvious to one skilled in the art that other thermal cathodes such as tungsten or lanthanum hexaboride could be used, or that a field emission type cathode could be employed if required to obtain desired beam current density. Additionally, while the tubes 121 have been described as comprising electron beam tubes, it is also believed obvious that charged particles other than electrons such as positive ions could be employed in the tube by appropriate design to substitute a positive ion source for the electron gun 122**. It is also believed obvious that a demountable, evacuable column could be employed in place of a sealed-off evacuated tube as shown.

The beam of electrons 13 is projected through a condenser lens 123 comprised by an axially aligned assembly of apertured metallic members separated by insulators for imaging the beam of electrons 13. Energizing potentials are supplied to electron gun 122 and condenser lens 123 from an electron gun power supply 14. As shown in FIG. 1, the filament supply voltage $V_F$ is supplied to the filament of the cathode of the electron gun and a cathode voltage $-V_C$ is applied to both the cathode **122*a* and the control grid 122*b* of the gun. An anode energizing potential $V_A$ is supplied to the anode 122*c* of the electron gun and to each of the outer apertured plate elements 123*a* and 123*c* of the condenser lens assembly 123. A lens focusing potential $V_L$ is supplied to the central aperture lens element 123*b* of the assembly for controlling focus and divergence of the electron beam passing through the assembly as will be described hereafter. Although the lens assembly 123** is illustrated as being of the Einzel lens type with outer elements at the same potential, it is believed obvious to one skilled in the art that an acceleration or deceleration lens could be employed in place of the Einzel lens assembly shown if a different electron or other charged particle potential is desired at the entrance to the eight-fold coarse deflector than that at the anode of the electron gun.

After passing through the condenser lens assembly, the electron beam enters a two stage, eight-fold coarse deflector assembly which is divided into two different, serially arranged sections **17*a* and 17*b*. Each of the sections 17*a* and 17*b* is similar in construction and design to the eight-fold deflector assembly described in greater detail with relation to FIGS. 1 and 3 of the above referenced U.S. Pat. No. 4,142,132. The second section 17*b* normally is designed to have larger inlet and outlet diameter for the frusto-conical shaped deflector assembly than is true of the first section 17*a*, however, the cylindrical limit (equal inlet end and outlet end diameters) may be used for either or both sections. The first section of the two stage, eight-fold coarse deflector 17*a* deflects the beam of electrons 13 along an outwardly directed path at an angle away from the center axis of the electron beam. The second section 17*b* has essentially the same voltages applied thereto as the first section 17*a*, but with the voltages being phase rotated 180°, so that in effect the second section 17*b* deflects the electron beam back towards and parallel to its original path along the center axis of the tube. The relative lengths of the two sections 17a and 17b are chosen so that the electron beam leaving the second section 17b is again parallel to the center axis of the EBAM tube (and hence the center axis of the electron beam). If desired, fine tuning may be achieved by multiplying the deflection voltage supplied to the deflector members of the second section 17b** by an adjustable factor "b" as described more fully in the above referenced U.S. Pat. No. 4,142,132.

The electron beam 13 which has been deflected by the two stages of the eight-fold coarse deflector assembly 17a and 17b, exits the coarse deflector assembly at a physically displaced location which is in substantial axial alignment with a desired one of a planar array of a plurality of fine micro deflector openings shown at 124 after passing through a corresponding axially aligned fine objective lenslet comprising a part of a fly's eye micro lens array shown at 125. The objective micro lens array 125 preferably is of the Einzel unit potential type to facilitate operation of all deflection and target signals referenced to DC ground potential. The micro lens array 125 consists of three axially aligned conductive plates each having an array of aperture openings which are axially aligned with a corresponding aperture in the adjacent plates plus extra holes around the periphery to preserve field symetry. Lens tolerances, particularly the roundness of the holes, is controlled to very tight limits in order to minimize aberrations introduced by the micro lens array. Each one of the aperture openings of the array defines a fine micro lenslet which is followed by a corresponding axially aligned micro deflector opening defined by the assembly 124 for deflecting the electron beam which passes through a selected one of the individual micro lenslets to impinge upon a predetermined x-y planar area of a target element 18.

The fine deflector assembly 124 is comprised of two separate sets of parallel bars 124a and 124b which extend at right angles to each other as described more fully in the above referenced U.S. Pat. No. 4,142,132 in order to achieve necessary fine x-y deflection of the electron beam over a preassigned area of the target surface for a given micro lenslet. Mechanical tolerances are not stringent since the structureless MOS target element 18 allows for considerable variation in deflection sensitivity. By utilizing the same deflection potentials for both writing and reading precise location of data stored at the target plane during read-out, is assured. However, stability of mechanical construction is important to minimize sensitivity to vibrations.

The target element 18 in the compound, fly's eye EBAM system of FIG. 1 is similar to the MOS target element 18 described in greater detail in the above referenced U.S. Pat. No. 4,142,132 and the prior art references cited therein. The target element 18 incorporates sufficient electrical segmentation to reduce the capacitance of each segment to a value compatible with high operational speeds of the order of a 10 megahertz read rate. The bit packing density of the target element has been shown to extend down to at least 0.6 microns. This is realized through the combination of the two stage, eight-fold electrostatic coarse deflector system which allows the electron beam to access a desired one of the array of micro lenslets, and thereafter the x-y micro deflector for each micro lenslet, can address an array of spots each approximating the electron beam diameter in each lenslet field of view thereby greatly increasing the capacity of the compound, flys' eye, array optics, EBAM system. By these design features, the total addressing capability of the system shown in FIG. 1 can be almost six hundred million spots for each EBAM tube. The capacity of any memory system employing such EBAM tubes then is determined by the total number of EBAM tubes employed in the system.

The requirements of a coarse, two stage, eight-fold deflector system 17a and 17b as shown in FIG. 1 are first, that the electron beam must exit the coarse deflector system parallel to the electron beam tube center axis in order to avoid degrading the performance of the array of fine micro lenslets 125 by off-axis rays. Secondly, the virtual image of the coarse deflector system (i.e. projection of the exit rays to the smallest virtual focus) must not move off of the system axis as the deflection voltage is varied in order to avoid movement of the image of each fine lenslet in the fine micro lenslet array thereby avoiding the need for ultrastable cathode/deflector voltage sources. Thirdly, the virtual image from the set of rays which are radially displaced from the center axis of the system and from a set of circumferential rays must coincide at the outlet of the coarse deflector system in order to avoid astigmatism. In the EBAM system disclosed in the above referenced U.S. Pat. No. 4,142,132 it was supposed that these three conditions could all be met if the coarse deflector is in a collimating mode. To be in a collimating mode, the bundle of rays entering the deflector must act as though they originated from a source point or origin which is spaced an infinite distance from the entrance to the deflector so that the bundle of rays entering the deflector are parallel to the system axis and exit the deflector parallel to the axis but displaced radially sufficiently to be aligned with a desired fine micro lenslet in the fine, fly's eye array optics system. It has now been determined that this supposition is not correct, as will be explained more fully hereinafter.

Deflection voltages are supplied to each of the respective deflector members of the first and second stage coarse deflectors 17a and 17b from an eight-fold coarse deflector voltage generator 21 through coarse deflection amplifiers 19 (and 19a, if used). The respective x coarse address and y coarse address is supplied to the eight-fold coarse deflector voltage generator 21 from a central computer accessing equipment with which the memory is used. Fine deflection voltages are supplied to the micro deflector assembly 124a and 124b of each EBAM tube from a four-fold, fine deflector voltage generator 131 through fine deflection amplifiers 132. Appropriate x fine address and y fine address signals are supplied to the four-fold fine deflector voltage generator 131 from the main computer accessing equipment. Voltage generators 21 and 131 are described more fully in U.S. Pat. No. 4,142,132. A dynamically corrected objective lens potential $V_{OBJ(C)}$ voltage is supplied to the fine objective micro lens array 125 from a dynamic focus generator 22, the construction of which will be described more fully hereinafter in connection with FIG. 2 of the drawings. It is important to note, however, that the dynamic focus generator 22 derives its dynamically corrected objective lens energizing potential from both the fine deflector voltage generator 131 and the coarse deflector voltage generator 21 as well as an uncorrected constant potential $V_{OBJ(C)}$ supplied from an objective lens voltage supply 23.

Instead of a perfectly collimated input electron beam (i.e. bundle of rays all parallel to the system axis), as described above and with relation to the electron beam tube and system disclosed in U.S. Pat. No. 4,142,132, it has been determined that by causing the electron beam to be comprised of a bundle of rays which slightly diverge at a small angle of divergence in advance of passing through the eight-fold electrostatic coarse deflector, results in significantly reducing residual astigmatism of the electron beam tube or column. This fact has been proven both experimentally and by computer simulation. Based on the simulation of an electron tube geometry having an eight-fold deflector system using an eleven inch long deflector cone, the astigmatism at a corner lenslet (1.086 inches from center) was reduced from 3.9 microns to 1.5 microns in the Gaussian plane. By the addition of a dynamic focus correction as described more fully hereinafter with respect to FIG. 2, the astigmatism was reduced from 2.7 microns to 0.3 microns at the corner lenslet, in going from a parallel beam input to a beam with a divergence angle of 1.2 times $10^{-4}$ radians (source point 5.0 inches in front of the deflector).

In the embodiment of the invention shown in FIG. 1 of the drawings, the means for introducing the slight angle of divergence into the rays of the electron beam in advance of its passing through the eight-fold coarse deflector, comprises a condenser lens assembly formed by elements 123*a*, 123*b* and 123*c*. By appropriate adjustment of the lens aperture element voltage $V_L$ applied to the aperture plate 123*b*, the virtual origin or source point of the electron beam and hence the angle of divergence of the rays forming the beam can be adjusted for optimal minimization of residual astigmatism. The one condenser lens electron source beam tube shown in FIG. 1 requires a modest increase in the overall length of the electron beam tube 121 in order to accomodate the condenser lens assembly as opposed to a no-condenser lens electron source beam tube illustrated in FIG. 6, as will be described hereafter. However, the modest increase in length may be justified by the increase in flexibility of adjusting the virtual origin or source point of the beam and hence the divergence angle by changing the value of the potential $V_L$ applied to the aperture element 123*b*. By changing the lens strength, both the beam source point and image size may be changed, but not independently one from the other.

Figure 6:
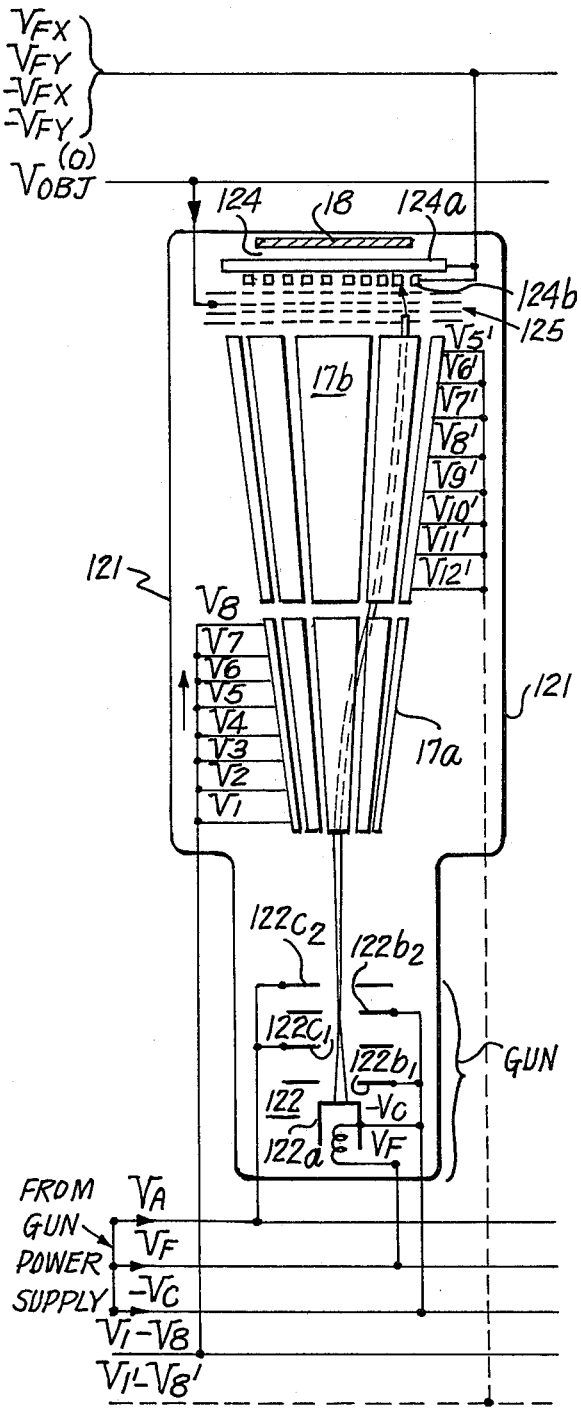
FIG. 6 is a schematic illustration of a modified EBAM tube for use in the system shown in FIG. 1 wherein no condenser lens is employed in the tube intermediate the electron gun and the input to the eight-fold coarse electrostatic deflector.

FIG. 6 of the drawings illustrates a highly desirable electron beam tube design for practicing the invention wherein no condenser lens assembly is employed. The electron beam tube shown in FIG. 6 is preferred since it is the simplest in design, requires no voltages beyond the filament, cathode and anode voltages needed for the electron gun (in addition to the deflection potentials). Since it has the fewest elements, the no-condenser lens tube of FIG. 6 is simpler and is shortest in length. With the FIG. 6 arrangement, however, it is desirable to employ a pentode electron gun configuration which utilizes first and second control grids 122*b*$_1$ and 122*b*$_2$ to which are applied the cathode potential $-V_C$ and two anode elements 122*c*$_1$ and 122*c*$_2$ to which are applied the anode potential $V_A$. With this design, the electron beam origin or source point and hence divergence angle is controlled by appropriate spacing of the second control grid 122*b*$_2$ from the first and second anodes 122*c*$_1$ and 122*c*$_2$, respectively, the size of the aperture opening in the second control grid 122*b*$_2$ and the spacing of the second anode element 122*c*$_2$ from the entrance into the eight-fold deflector system. The image size is controlled by appropriately sizing the aperture opening in the second anode 122*c*$_2$. The disadvantage of the no-condenser lens beam tube shown in FIG. 6 is its relative inflexibility due to the fact that both the beam source point and hence divergence angle and the electron-optical image size are fixed once the gun design parameters are chosen.

Figure 7:
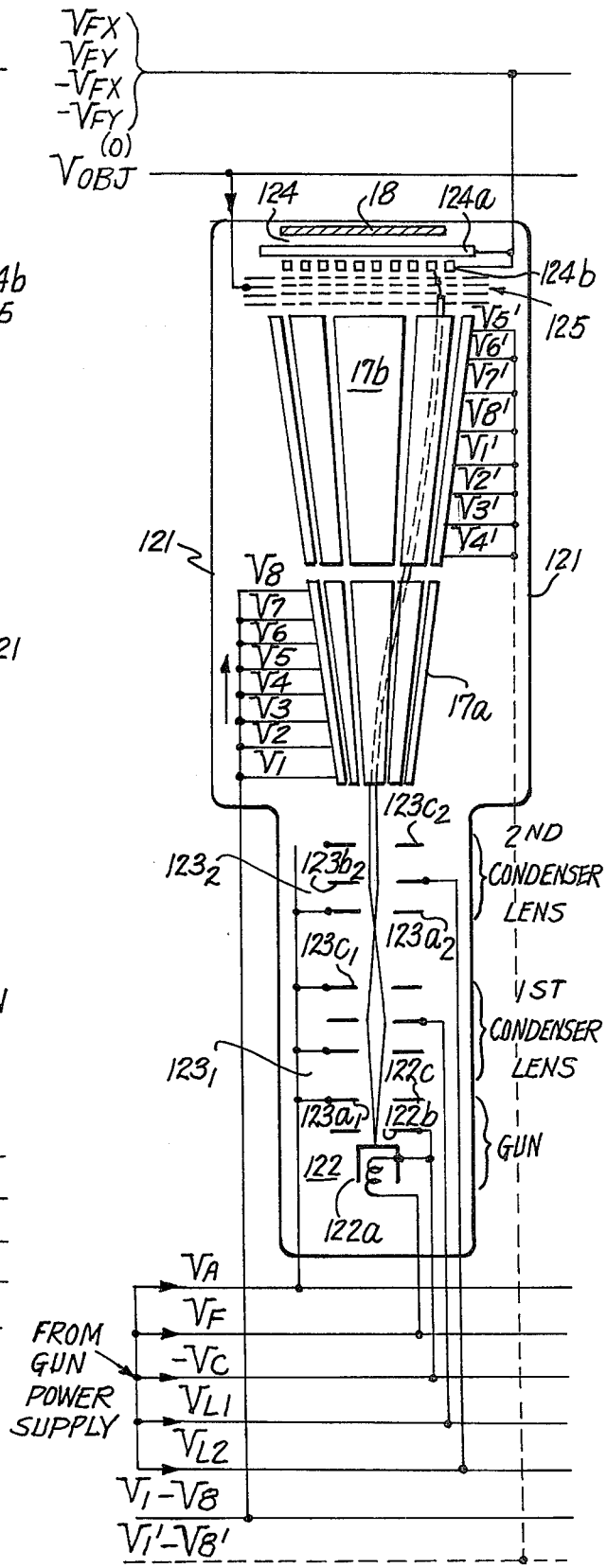
FIG. 7 is a schematic illustration of still a different design EBAM tube for use with the system of FIG. 1 wherein there are two, serially arranged, condenser lens assemblies interposed between the electron gun and the coarse eight-fold electrostatic deflector system of the EBAM tube.

FIG. 7 of the drawings illustrates an embodiment of the compound, fly's eye electron beam tube 121 which employs a two stage condenser lens assembly comprised by a first stage assembly 123$_1$ and a second stage assembly 123$_2$ interposed between the anode of the electron gun 122 and the entrance to the dual, eight-fold deflector assembly 17*a* and 17*b*. The two stage condenser lens assembly requires two separate lens voltages $V_{L1}$ and $V_{L2}$, applied to the aperture elements 123*b*$_1$ and 123*b*$_2$, respectively, of the first and second condenser lens assemblies. The introduction of the second stage condenser lens assembly results in a considerable increase in length of the gun-to-coarse deflector section of the beam tube 121 (approximately twice the length of the corresponding gun-to-coarse deflector section of the no-condenser lens electron beam tube design shown in FIG. 6). However, in return, one obtains the flexibility to change both the source point (divergence angle) and the image size independently by manipulation of both the lens potential $V_{L1}$ and $V_{L2}$ applied to the first and second stages respectively of the condenser lens assembly.

The explanation for the improvement in reduction of residual astigmatism by reason of the slightly diverging electron beam introduced at the input of the two state, eight-fold deflector system as described above with relation to FIGS. 1, 6 and 7, is believed to be as follows: Consider a coarse deflector system tuned to produce an output bundle of rays of electrons parallel to the deflector system axis at all voltages, for an input bundle of rays along the axis. This is the condition for collimation achieved with the eight-fold double deflector system described in U.S. Pat. No. 4,142,132. Consider three such rays in a bundle at voltages V, $V+\delta V$ and $V-\delta V$, where $\delta V$ is small as shown in FIG. 3 of the drawings. These rays may be considered to form a "voltage bundle" (also referred to as a "virtual voltage bundle") which is well collimated.

Figure 4:
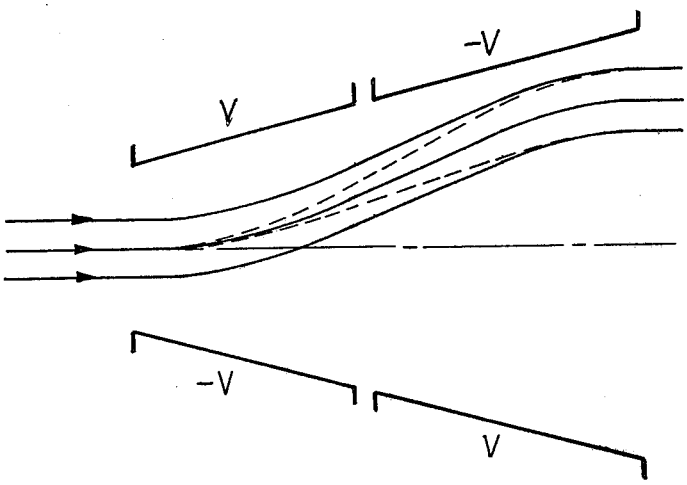
FIG. 4 is a modification of the schematic diagram shown in FIG. 3 to add to the voltage path characteristics, the parallel-electron ray input paths corresponding to the voltage paths illustrated in FIG. 3.

Now consider a parallel-electron beam (real) input ray bundle, shown by solid lines in FIG. 4 of the drawings. It should be noted with respect to FIG. 4 that there is a considerable difference in the trajectories between the (real) ray bundle (shown in solid lines) and the "voltage bundle" (shown in dashed lines), especially in the first section of the deflector system. Since the "voltage bundle" or "virtual voltage bundle" is well collimated, it will be seen that the (real) electron ray bundle is not and therefore exhibits astigmatism at the target plane. It is believed that this astigmatism is caused by anistropic miscollimation across the electron ray bundle. The presence of this astigmatism is verified both by computer simulation and experimental observation.

Figure 5:
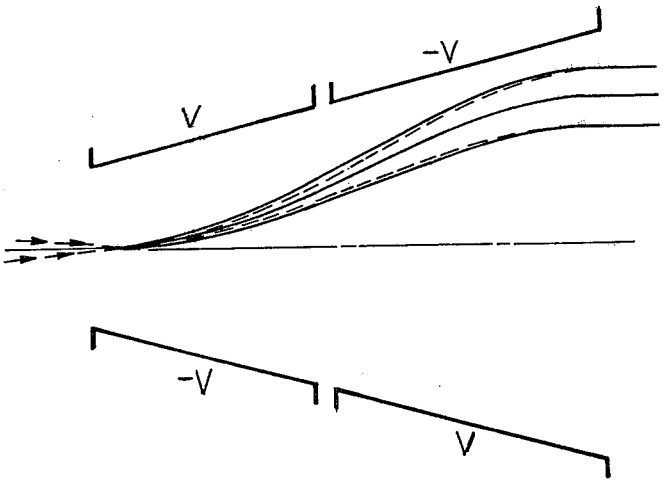
FIG. 5 is a functional illustration of the modification to the electron ray paths wrought by the present invention wherein a slightly diverging electron beam input ray bundle is caused to traverse the eight-fold electrostatic deflector system as opposed to the highly collimated beam employed in the prior art apparatus described in U.S. Pat. No. 4,142,132 and shown in FIGS. 3 and 4.

In place of the well-collimated ray bundle, one can employ instead a diverging electron beam input ray bundle produced by suitable location of the source point or origin as shown by the solid lines in FIG. 5 of the drawings, where the source point or origin of the slightly diverging bundle of rays is chosen to be in advance of the entrance to the deflector system, either at the entrance, or slightly ahead of the entrance. With such arrangement, it will be seen in FIG. 5 that the trajectories of the (real) electron beam ray bundle are more nearly congruent with the trajectories of the "voltage bundle", and that therefore the diverging (at the entrance) real electron ray bundle should have less anistropic miscollimation at the deflector exit and hence less astigmatism at the target plane. As noted earlier, this has been determined to be the case both by computer simulation and by empirical observation.

The optimum diverging real ray bundle electron beam source point or origin is found to be not quite at the coarse deflector entrance, but instead about 15–20% of the deflector length ahead of the entrance for several beam tube geometries that have been observed. This shift results from (a) the second order difference between the real ray bundle and the "voltage bundle" voltages (all V for the ray bundle and $V \pm \delta V$ for the "voltage bundle"); and (b) the fact that the real ray bundle and "voltage bundle" trajectories do not quite match. Additionally, it should be noted that by using a diverging real input ray bundle, one introduces some deflector sweep, which increases as the diverging ray electron beam origin moves from $-\infty$ toward the deflector assembly. Final choice of the origin of the diverging ray bundle thus may be a compromise between optimum astigmatism reduction and minimum sweep.

Figure 2:
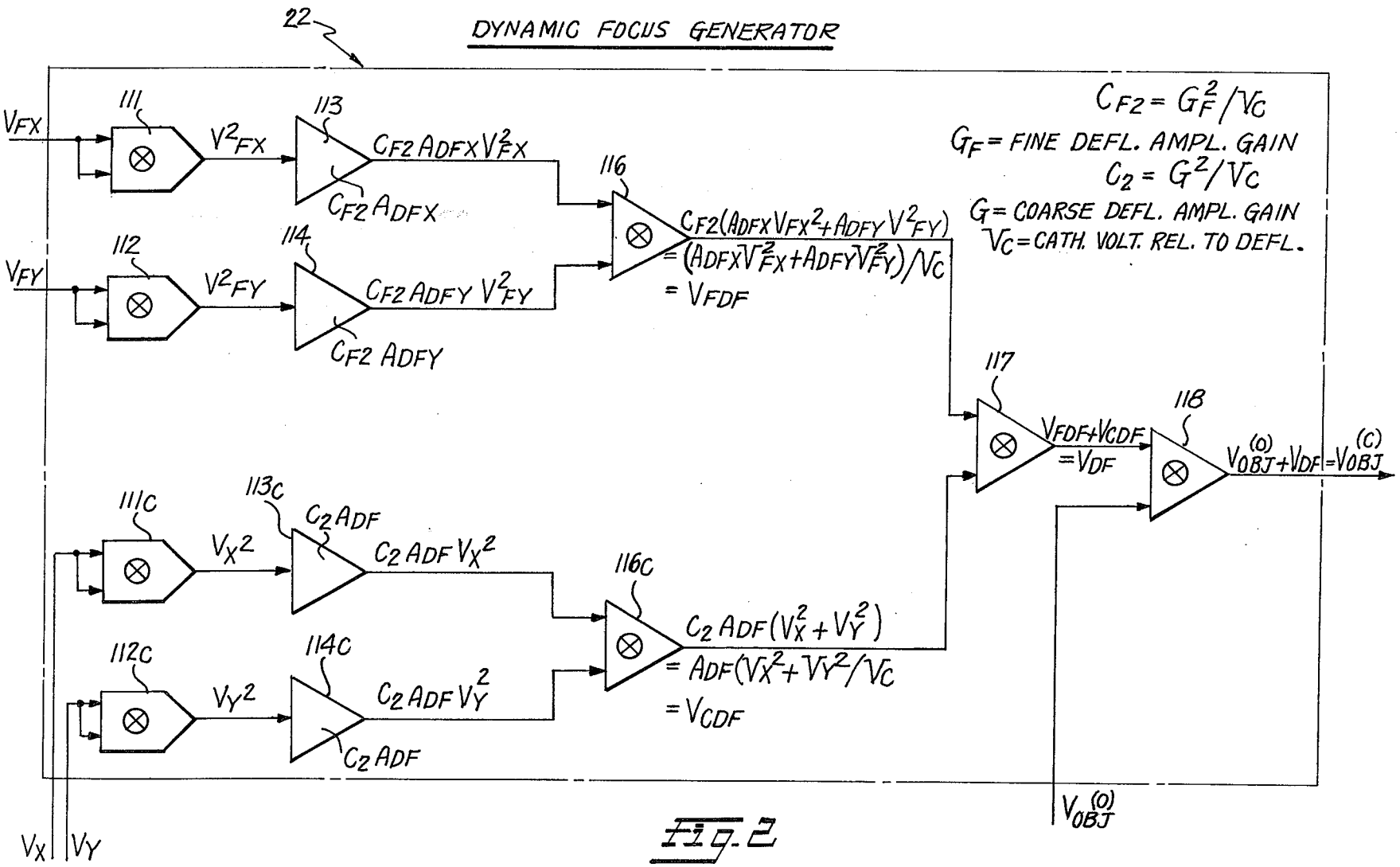
FIG. 2 is a functional block diagram illustrating the circuit construction of a dynamic focus generator constructed according to the invention whereby a dynamic focusing potential can be derived for application to the objective lens array of the compound fly's eye EBAM tube which is derived from both the coarse and fine deflection potentials applied to the tube.

In addition to introducing a slight divergence to the electron beam rays in advance of entering the two stage, eight-fold coarse deflector, it has been determined that further minimization of astigmatism at the target plane can be obtained by the application of a dynamic focusing correction electric potential to the micro objective lens assembly 125 of the compound, fly's eye electron beam tube 121. In U.S. Pat. No. 4,142,132 a dynamic focus electric potential generator was disclosed wherein the dynamically corrected focus potential was derived from the fine deflection voltages. FIG. 2 of the drawings discloses an improved dynamic focus generator 22 for use in the system of FIG. 1 wherein the dynamically corrected focus potential for application to the objective micro lens assembly 125 is derived from both the fine deflection voltages and the coarse deflection voltages. As seen in FIG. 2, the dynamic focus generator 22 of FIG. 1 is comprised by a pair of input multiplier amplifiers 111 and 112 of conventional, commercially available, integrated circuit construction. The $v_{FX}$ low level fine deflection voltage is supplied as the input to the multiplier 111 for multiplication by itself to derive at the output of multiplier 111 a signal $v_{FX}^2$. Similarly, the low level fine deflection voltage $v_{FY}$ is supplied to the input of the multiplier 112 for multiplication by itself to derive at the output of multiplier 112 a signal $v_{FY}^2$. An operational amplifier 113 of conventional, commercial construction is provided having a transfer function $C_{F2}$ $A_{DFX}$ is connected to the output of multiplier 111 for deriving at its output a signal $C_{F2}A_{DFX}v_{FX}^2$ where the value $C_{F2}$ is a scaling factor having the value $G_F^2/V_C$ with $G_F$ being equal to the fine deflection amplifier gain and potential $-V_C$ being equal to the cathode voltage relative to the coarse deflector system. $A_{DFX}$ is a constant determined by the design parameters of the fine X deflection system as explained more fully in U.S. Pat. No. 4,142,132. The multiplier 112 has its output supplied through an operational amplifier 114 similar in construction to amplifier 113 but having the transfer function $C_{F2}$ $A_{DFY}$ and which derives at its output a signal $C_{F2} \cdot A_{DFY} \cdot v_{FY}^2$. The constant $A_{DFY}$ again is a constant determined by the parameters of the fine Y deflection system. The outputs of the multiplier circuits 113 and 114 are supplied to a summing amplifier 116 of conventional, commercially available construction which then derives a dynamic fine correction potential $C_{F2}(A_{DFX} \cdot v_{FX}^2 + A_{DFY} \cdot v_{FY}^2) = (A_{DFX} \cdot V_{FX}^2 + A_{DFY} \cdot V_{FY}^2)/V_C = V_{FDF}$ where $V_{FX} = G_F v_{FX}$ and $V_{FY} = G_F v_{FY}$ are the X and Y fine deflection plate voltages, respectively, and where $V_{FDF}$ is the dynamic focus correction potential derived from the fine deflection voltages.

The coarse deflection potentials $v_X$ and $v_Y$ are supplied through respective multiplier amplifiers 111C, 112C, through operational amplifiers 113C and 114C, respectively, to a second summing amplifier 116C where the multipliers, operational amplifier and summing amplifier 116C all are similar in construction and operation to the correspondingly numbered elements described with relation to the fine deflection channel, but which instead operate on the coarse deflection voltages $v_X$ and $v_Y$. At the output of the summing amplifier 116C, a coarse dynamically corrected focus potential $V_{CDF}$ is derived which is equal to $$C_2 A_{DF}(v_X^2 + v_Y^2) = \frac{A_{DF}(V_X^2 + V_y^2)}{v_C}$$

where $C_2$ is a scaling factor having the value $G^2/V_C$ with G being equal to the coarse deflection amplifier gain, $A_{DF}$ is a constant, and $V_X = Gv_X$ and $V_Y = Gv_Y$ are the coarse X and Y deflection plate voltages, respectively. The constant $A_{DF}$ can be determined either empirically or by computer simulation and depends upon the location of the beam source point or origin relative to the entrance to the coarse deflector, the physical parameters of the coarse deflector assembly and the voltage dependence of the focal plane position of the objective lens.

The fine dynamic focus correction potential $V_{FDF}$ derived at the output of summing amplifier 116 and the coarse dynamic focus correction potential $V_{CDF}$ derived at the output of summing amplifier 116C, are supplied as inputs to an output summing amplifier 117 which derives at its output the dynamic focus correction potential $V_{DF} = V_{FDF} + V_{CDF}$. A third summing amplifier 118, again of conventional, commercial construction, sums together the dynamic focus correction potential $V_{DF}$ which was derived from both the coarse deflection potentials and the fine deflection potentials as is evident from the preceeding description together with the uncorrected, constant objective lens potential $V_{OBJ(CO)}$ supplied from the objective lens voltage supply 23 as shown in FIG. 1. Summing amplifier 118 then operates to derive at its output the dynamically corrected, objective lens focus potential $V_{OBJ(C)}$ for application to the compound, fly's eye objective micro lens assembly 125 of the electron beam tube 121.

From the foregoing description it will be appreciated that the present invention provides a new method and system for minimizing electron beam aberrations and the effect thereof at the image plane of electron beam tubes and columns and other similar charged particle apparatus. The system is particularly suitable for use with electron beam tubes or demountable columns of the two stage, compound, fly's eye type wherein a two stage eight-fold electrostatic coarse deflector system is employed in conjunction with a fly's eye micro lens and micro deflector system in a single tube or column structure. It should be noted, however, that the invention is not restricted in its application to use with electron beam tubes of the compound fly's eye type employing eight-fold electrostatic coarse deflectors but may be used with any known deflector system employed in electron beam or other charged particle beam tube or column wherein the deflector system is followed by lens. For example, the invention can be employed with electron or other charged particle beam tubes having four-fold electrostatic deflector systems, parallel plate deflector systems, so-called "deflectron" deflector systems or even magnetic deflection systems wherein the deflector system is followed by an objective or projection lens. Accordingly, having described several embodiments of the new and improved electron beam and other charged particle apparatus constructed according to the invention, it is believed obvious that other modifications and variations of the invention will be suggested to those skilled in the art in the light of the above teachings. It is therefore to be understood that changes may be made in the particular embodiments of the invention which are within the full intended scope of the invention defined by the appended claims.

We claim:

1. In an all electrostatic electron beam tube having an evacuated housing, electron gun means disposed at one end of the evacuated housing for producing a beam of electrons, electrostatic deflector means secured on the housing and disposed about the path of the beam of electrons, means for applying deflection electric potentials to the deflector means for deflecting the electron beam to a desired point on a target plane, and lens means axially aligned with said deflector means and disposed intermediate the deflector means and the target plane, the improvement comprising the addition of electron beam divergence means for causing the electron beam to diverge at a small angle of divergence from a source point located at or near the entrance to the deflector and while entering the deflector in contrast to an electron beam from a source point an infinite distance away having substantially parallel rays as is the case with a collimated electron beam whereby electron beam astigmatism at the target plane is minimized.

2. An all electrostatic electron beam tube according to claim 1 wherein said electron beam divergence means is comprised by appropriately designing the electron gun means including the spacing of the aperture formed in the anode of the electron gun means from the control grid thereof, the size and shape of the aperture, the spacing of the anode from the entrance into the deflector means, and by adjustment of the values of the energizing potentials applied to the electron gun means.

3. An all electrostatic electron beam tube according to claim 1 wherein said electron beam divergence means comprises condenser lens means interposed in the electron beam tube intermediate the electron gun means and the deflector means, said condenser lens means including at least an outer lens plate element having a central opening therein for passage of the electron beam and an inner lens aperture element, and wherein said electron beam divergence is controlled by varying of the energizing potential applied to said inner lens aperture element.

4. An all electrostatic electron beam tube according to claim 3 wherein said condenser lens means is comprised by serially arranged first and second condenser lens assemblies each comprised by at least an outer lens plate element and an inner lens aperture element and the electron beam divergence is controlled by varying the value of the energizing potential applied to the inner lens aperture element of the second condenser lens assembly.

5. An all electrostatic electron beam tube according to claim 1 wherein the electron beam tube has an eight-fold electrostatic deflection system and said deflector means comprises eight electrically conductive spaced apart members which are electrically isolated one from the other and annularly arranged around the center electron beam path, and further including means for applying correction electric potentials to the respective members of the eight-fold deflector means in conjunction with the deflection electric potentials to minimize electron beam spot aberration at the target plane, said means for applying correction electric potentials to the respective deflector members of the eight-fold deflector means comprising means for applying two different quadrupole correction electric potentials to selected ones of the eight-fold deflector members and means for applying an octupole correction electric potential to all eight deflector members.

6. An all electrostatic electron beam tube according to claim 5 wherein said electron beam divergence means comprises appropriately designing the electron gun means including the spacing of the aperture formed in the anode of the electron gun means from the control grid thereof, the size and shape of the aperture, the spacing of the anode from the entrance into the eight-fold deflector system, and by adjustment of the values of the energizing potentials applied to the electron gun means.

7. An all electrostatic electron beam tube according to claim 5 wherein said electron beam divergence means is comprised by condenser lens means interposed in the electron beam tube intermediate the electron gun means and the eight-fold deflector means, said condenser lens means including at least an outer lens plate element having a central opening therein for passage of the electron beam and an inner lens aperture element, and wherein said electron beam divergence is controlled by varying the energizing potential applied to said inner lens aperture element.

8. An all electrostatic electron beam tube according to claim 5 wherein said condenser lens means is comprised by serially arranged first and second condenser lens assemblies each comprised by at least an outer lens plate element and an inner lens aperture element and the electron beam divergence is controlled by varying the value of the energizing potential applied to the inner lens aperture element of the second condenser lens assembly.

9. An all electrostatic electron beam tube according to claim 1 wherein said lens means comprises a fine objective lens for finely focusing the electron beam after deflection by said deflector means and further including means for applying a dynamic focusing correction potential to the fine objective lens with the dynamic focusing correction potential being derived at least in part from both the coarse and fine deflection electric potentials applied to the deflector means.

10. An all electrostatic electron beam tube according to claim 5 wherein said eight-fold deflector means comprises coarse deflector means for a compound fly's eye type electron beam tube and further includes a fine micro deflector system disposed between the target plane and the lens means within the evacuated housing, and wherein the lens means comprises a fine objective lens means of the fly's eye type having a plurality of micro lenslets disposed between the eight-fold coarse deflector system and the fine micro deflector system, said eight-fold coarse deflector means comprising two eight-fold sections with each section comprising eight electrically conductive elemental members which are electrically isolated one from the other and are annularly arranged around the center electron beam path and with the elemental deflector members of the first section interconnected electrically with the 180° opposed deflector members of the second section, and means for supplying deflection electric potentials to the respective members of the first section for electrostatically deflecting the electron beam to a desired micro lenslet of said objective lens means.

11. An all electrostatic electron beam tube according to claim 10 further including means for applying a dynamic focusing correction potential $V_{OBJ(C)}$ to the fine objective lens means that is derived from deflection potentials applied to both the coarse and fine deflector systems of the tube.

12. An all electrostatic electron beam tube according to claim 11 wherein a dynamic focusing correction electric potential $V_{OBJ(C)}$ is derived from both the eight-fold coarse deflection potentials and the fine deflection potentials in accordance with the following values:

$$V_{OBJ(C)}=V_{OBJ(O)}+V_{DF}$$

where $V_{OBJ(O)}$ is the uncorrected constant value of the fine objective lens supply voltage and $V_{DF}=V_{FDF}+V_{CDF}$ where $V_{FDF}$ is given by the expression $$V_{FDF}=\frac{(A_{DFX}V_{FX}^2+A_{DFY}V_{FY}^2)}{V_C}$$

where $A_{DFX}$ and $A_{DFY}$ are constants determined by the design parameters of the electron beam tube fine deflection elements, $V_{FX}$ is the value of the fine X-axis deflection voltage, $V_{FY}$ is the value of the fine Y-axis deflection voltage and $-V_C$ is the cathode voltage of the electron gun means, and where $V_{CDF}$ is given by the expression $$V_{CDF}=\frac{A_{DF}(V_X^2+V_Y^2)}{V_C}$$

where $A_{DF}$ is a constant determined by the design parameters of the eight-fold coarse deflection system, $V_X$ is the value of the coarse X-axis deflection voltage, $V_{FY}$ is the value of the coarse Y-axis deflection voltage and $-V_C$ is the cathode voltage of the electron gun means.

13. An all electrostatic electron beam tube according to claim 12 wherein said electron beam divergence means is comprised by appropriately designing the electron gun means including the spacing of the aperture formed in the anode of the electron gun means from the control grid thereof, the size and shape of the aperture, the spacing of the anode from the entrance into the eight-fold deflector system, and by adjustment of the values of the energizing potentials applied to the electron gun means.

14. An all electrostatic electron beam tube according to claim 12 wherein said electron beam divergence means is comprised by condenser lens means interposed in the electron beam tube intermediate the electron gun means and the eight-fold deflector means, said condenser lens means including at least an outer lens plate element having a central opening therein for passage of the electron beam and an inner lens aperture element, and wherein said electron beam divergence is controlled by varying the value of the energizing potential applied to said inner lens aperture element.

15. An all electrostatic electron beam tube according to claim 14 wherein said condenser lens means is comprised by first and second serially arranged condenser lens assemblies each comprised by at least an outer lens plate element and an inner lens aperture element and the electron beam divergence is controlled by varying the value of the energizing potential applied to the inner lens aperture element of the second condenser lens assembly.

16. The method of operating an electron beam tube having an all electrostatic deflection system and comprising an evacuated housing, electron gun means disposed at one end of the evacuated housing for producing a beam of electrons, deflector means secured on the housing and disposed about the path of the beam of electrons, means for applying deflection electric potentials to the repective deflector members of the deflector means for deflecting the electron beam to a desired point on a target plane, and lens means axially aligned with the deflector means and disposed intermediate the deflector means and the target plane; said method comprising causing the electron beam to diverge at a small angle of divergence at or slightly in advance of and while entering the deflector means to thereby minimize electron beam spot astigmatism at the target plane.

17. The method according to claim 16 wherein the electron beam tube has an eight-fold electrostatic deflection system and said deflector means comprises eight electrically conductive spaced-apart members which are electrically isolated one from the other and annularly arranged around the center electron beam path, said method further comprising applying correction electric potentials to the respective members of the eight-fold deflector means in conjunction with the deflection electric potentials to further minimize electron beam spot aberration at the target plane with said correction electric potentials comprising two different quadrupole correction electric potentials applied to selected ones of the eight-fold deflector members and an octupole correction electric potential applied to all eight deflector members.

18. The method according to claim 17 wherein the electron beam tube is of the compound fly's eye type, the eight-fold deflector means comprises the coarse deflector system of the electron beam tube and the tube further includes a fine deflector system disposed between the eight-fold coarse deflector means and the target plane, and the lens means comprises a plurality of micro lenslets of the fly's eye type interposed between the eight-fold coarse deflector system and the fine deflector system; and wherein the method further includes applying a dynamic focusing correction potential $V_{OBJ(C)}$ to the lens means which is derived from both the coarse deflection potentials applied to the coarse eight-fold deflector means and the fine deflection potentials applied to the fine deflector means.

19. The method according to claim 18 wherein the objective lens dynamic focusing correction electric potential $V_{OBJ(C)}$ is derived from both the eight-fold coarse deflection potentials and the fine deflection potentials in accordance with the following values:

$$V_{OBJ(C)}=V_{OBJ(O)}+V_{DF}$$

where $V_{OBJ(O)}$ is the uncorrected constant value of the objective lens supply voltage and $V_{DF}=V_{FDF}+V_{CDF}$ where $V_{FDF}$ is given by the expression $$V_{FDF}=\frac{(A_{DFX}V_{FX}^2+A_{DFY}V_{FY}^2)}{V_C}$$

where $A_{DFX}$ and $A_{DFY}$ are constants determined by the design parameters of the electron beam tube fine deflection elements, $V_{FX}$ is the value of the fine X-axis deflection voltage, $V_{FY}$ is the value of the fine Y-axis deflection voltage and $-V_C$ is the cathode voltage of the electron gun means, and where $V_{CDF}$ is given by the expression $$V_{CDF}=\frac{A_{DF}(V_X^2+V_Y^2)}{V_C}$$

where $A_{DF}$ is a constant determined by the design parameters of the eight-fold coarse deflection system, $V_X$ is the value of the coarse X-axis deflection voltage, $V_{FY}$ is the value of the coarse Y-axis deflection voltage and $-V_C$ is the cathode voltage of the electron gun means.

20. In a charged particle beam tube having an all electrostatic deflection system comprising an evacuated housing, charged particle gun means disposed at one end of the evacuated housing for producing a beam of charged particles, eight-fold deflector means secured within the housing and disposed about the path of the beam of charged particles, said eight-fold deflector means comprising eight electrically conductive spaced-apart members which are electrically isolated one from the other and annularly arranged around the center charged particle beam path, means for applying deflection electric potentials to the respective members of the eight-fold deflector means for electrostatically deflecting the charged particle beam to a desired point on a target plane located at an opposite end of the evacuated housing from the charged particle gun means, and charged particle divergence means for causing the beam of charged particles to diverge at a small angle of divergence at or slightly in advance of and while entering said eight-fold deflector means.

21. A charged particle beam tube according to claim 20 further including means for applying correction electric potentials to the respective members of the eight-fold deflector means in conjunction with the deflection electric potentials to minimize charged particle beam spot aberration at the target plane, said means for applying correction electric potentials to the respective members of the eight-fold deflector means comprising means for applying two different quadrupole correction electric potentials to respective ones of the eight-fold deflector members and means for applying an octupole correction electric potential to all eight deflector members.

22. A charged particle beam tube according to claim 21 wherein said eight-fold deflector means comprises coarse deflector means for a compound fly's eye type charged particle beam tube having both an eight-fold coarse deflector system and a fine deflector system disposed between the target plane and the eight-fold coarse deflector system within the evacuated housing and further including objective lens means of the fly's eye type interposed between the eight-fold coarse deflector system and the fine deflector system.

23. A charged particle beam tube according to claim 22 wherein an objective lens dynamic focusing correction electric potential $V_{OBJ(C)}$ is derived from both the eight-fold coarse deflection potentials and the fine deflection potentials in accordance with the following values:

$$V_{OBJ(C)}=V_{OBJ(O)}+V_{DF}$$

where $V_{OBJ(O)}$ is the uncorrected constant value of the objective lens supply voltage and $V_{DF}=V_{FDF}+V_{CDF}$ where $V_{FDF}$ is given by the expression $$V_{FDF}=\frac{(A_{DFX}V_{FX}^2+A_{DFY}V_{FY}^2)}{V_C}$$

where $A_{DFX}$ and $A_{DFY}$ are constants determined by the design parameters of the charged particle beam tube fine deflection elements, $V_{FX}$ is the value of the fine X-axis deflection voltage, $V_{FY}$ is the value of the fine Y-axis deflection voltage and $-V_C$ is the cathode voltage of the electron gun means, and where $V_{CDF}$ is given by the expression $$V_{CDF}=\frac{A_{DF}(V_X^2+V_Y^2)}{V_C}$$

where $A_{DF}$ is a constant determined by the design parameters of the eight-fold coarse deflection system, $V_X$ is the value of the coarse X-axis deflection voltage, $V_{FY}$ is the value of the coarse Y-axis deflection voltage and $-V_C$ is the cathode voltage of the electron gun means.

24. In an all electrostatic electron beam tube of the fly's eye type having a coarse deflection system serially followed by a fine deflection system and comprising an evacuated housing, electron gun means disposed at one end of the evacuated housing for producing a beam of electrons, electrostatic coarse deflector means secured on the housing and disposed about the path of the beam of electrons, electrostatic fine deflector means secured on the housing and disposed in the path of the electron beam after passage through the coarse deflector means for finely deflecting the electron beam to a desired spot on a target plane, and means for applying respective deflection electric potentials to the respective coarse and fine deflector means for deflecting the electron beam to a desired point on a target plane; the improvement comprising the addition of electron beam divergence means for causing the electron beam to diverge at a small angle of divergence at or slightly in advance of and while entering said coarse deflector means.

25. An all electrostatic electron beam tube according to claim 24 wherein said electron beam divergence means is comprised by appropriately designing the electron gun means including the spacing of the aperture formed in the anode of the electron gun means from the control grid thereof, the size and shape of the aperture, the spacing of the anode from the entrance into the coarse deflector system, and by adjustment of the values of the energizing potentials applied to the electron gun means.

26. An all electrostatic electron beam tube according to claim 24 wherein said electron beam divergence means is comprised by condenser lens means interposed in the electron beam tube intermediate the electron gun means and the coarse deflector means, said condenser lens means including at least an outer lens plate element having a central opening therein for passage of the electron beam and an inner lens aperture element, and wherein said electron beam divergence is controlled by varying the value of the energizing potential applied to said inner lens aperture element.

27. An all electrostatic electron beam tube according to claim 26 wherein said condenser lens means is comprised by at least first and second serially arranged condenser lens assemblies each comprised by at least an outer lens plate element and an inner lens aperture element and the electron beam divergence is controlled by varying the value of the energizing potential applied to the inner lens aperture element of the second condenser lens assembly.

28. An all electrostatic electron beam tube according to claim 26 further including objective lens means secured within the tube housing intermediate the coarse deflector means and the fine deflector means for finely focusing the electron beam and means for applying a dynamic focusing correction potential to the condenser lens means or the objective lens means with dynamic focusing correction potential being derived at least in part from the coarse and fine deflection potentials.

29. The method of operating an all electrostatic electron beam tube of the fly's eye type having an electrostatic coarse deflection system and an electrostatic fine deflection system and comprising an evacuated housing, electron gun means disposed at one end of the evacuated housing for producing a beam of electrons, electrostatic coarse deflector means secured on the housing and disposed about the path of the beam of electrons, electrostatic fine deflector means disposed in the housing in the path of the electron beam for finely deflecting the electron beam to a desired spot on a target plane, and means for applying respective coarse and fine deflection electric potentials to the respective coarse and fine deflector means for deflecting the electron beam to a desired point on a target plane; said method comprising causing the electron beam to diverge at a small angle of divergence at or slightly in advance of and while entering the coarse deflector means.

30. The method according to claim 29 further comprising applying correction electric potentials to the respective coarse and fine deflector means in conjunction with the deflection electric potentials to minimize electron beam spot aberration at the target plane with said correction electric potentials being derived from the deflection potentials.

31. The method according to claim 29 wherein the electron beam tube further includes objective lens means of the fly's eye type interposed between the coarse deflector system and the fine deflector system; and wherein the method further includes applying a dynamic focusing correction potential to the objective lens means which is derived from both the coarse and fine deflection potentials.

32. The method according to claim 30 wherein the electron beam tube further includes objective lens means of the fly's type interposed between the coarse deflector system and the fine deflector system; and wherein the method further includes applying a dynamic focusing correction potential to the objective lens means which is derived from both the coarse and fine deflection potentials.

33. In an all electrostatic charged particle beam tube having an evacuated housing, charged particle gun means disposed at end one of the evacuated housing for producing a beam of charged particles, electrostatic deflector means secured within the housing and disposed about the path of the beam of charged particles, means for applying deflection electric potentials to the deflector means for deflecting the charged particle beam to a desired point on a target plane located at an opposite end of the evacuated housing from the charged particle gun means, and charged particle divergence means for causing the beam of charged particles to diverge at a small angle of divergence at or slightly in advance of and while entering said deflector means.

34. A charged particle beam tube according to claim 33 further including means for applying correction electric potentials to the deflector means in conjunction with the deflection electric potentials to minimize charged particle beam spot aberration at the target plane.

35. A charged particle beam tube according to claim 34 wherein said electrostatic deflector means comprises coarse deflector means for a compound fly's eye type charged particle beam tube having both an electrostatic coarse deflector system and an electrostatic fine deflector system disposed between the target plane and the coarse deflector system within the evacuated housing, and further including objective lens means disposed between the coarse and fine deflector systems, and means for applying a dynamic focusing potential to the objective lens means which is derived from both the coarse and fine deflection potentials.

* * * * *